US005164357A

United States Patent [19]

Bartman et al.

[11] Patent Number: 5,164,357

[45] Date of Patent: Nov. 17, 1992

[54] THERMALLY-RESPONSIVE RECORD MATERIAL

[75] Inventors: Gerald C. Bartman, New London; Steven L. Vervacke; Peggy D. Sands, both of Appleton, all of Wis.

[73] Assignee: Appleton Papers Inc., Appleton, Wis.

[21] Appl. No.: 710,493

[22] Filed: Jun. 5, 1991

[51] Int. Cl.[5] ..... B41M 5/30

[52] U.S. Cl. ..... 503/209; 503/214; 503/216; 503/217; 503/221

[58] Field of Search ..... 503/208, 209, 214, 216, 503/217, 221

[56] References Cited

U.S. PATENT DOCUMENTS

| | | | |
|---|---|---|---|
| 4,470,057 | 9/1984 | Glanz | 503/214 |
| 4,540,998 | 9/1985 | Bodmer et al. | 503/216 |
| 4,573,063 | 2/1986 | Miller et al. | 503/216 |
| 4,880,766 | 11/1989 | Miller et al. | 503/216 |

FOREIGN PATENT DOCUMENTS

| | | | |
|---|---|---|---|
| 62-19486 | 1/1987 | Japan | 503/216 |

*Primary Examiner*—Pamela R. Schwartz

*Attorney, Agent, or Firm*—Benjamin Mieliulis

[57] ABSTRACT

An improved heat-sensitive recording material is disclosed comprising a substrate, a binder, a chromogenic material, an electron-accepting color developer which reacts with said chromogenic material to form a color, and a color-stabilizing resin. The color stabilizing resin comprises an addition product of a diolefinic alkylated or alkenylated cyclic hydrocarbon or, an addition product of a phenol and a diolefinic alkylated or alkenylated cyclic hydrocarbon. The color-stabilizing resin, dye, and developer, have a weight percent resin phenolic group of about 5 or less. The heat-sensitive recording material has a fade index greater than 45. Imaged recording materials according to the invention resist fading when exposed to temperatures of 60° C. for prolonged periods such as twenty-four hour oven tests.

11 Claims, 1 Drawing Sheet

THERMALLY-RESPONSIVE RECORD MATERIAL

BACKGROUND OF THE INVENTION

1. Field of Invention

This invention relates to thermally-responsive record material. It more particularly relates to such record material in the form of sheets coated with color-forming systems comprising chromogenic material, and acidic color developer. This invention particularly concerns a thermally-responsive record material capable of forming an image resistant to fade or erasure. The invention teaches a record material having improved image density retention.

2. Description of Related Art

Thermally-responsive record material systems are well known in the art and are described in many patents, for example, U.S. Pat. Nos. 3,539,375; 3,674,535; 3,746,675; 4,151,748; 4,181,771; 4,246,318; and 4,470,057 which are incorporated herein by reference. In these systems, basic chromogenic material and acidic color developer material are contained in a coating on a substrate which, when heated to a suitable temperature, melts or softens to permit said materials to react, thereby producing a colored mark.

Thermally-responsive record materials have characteristic thermal responses, desirably producing a detectable image of certain intensity upon thermal exposure which can be in a selective pattern or manner.

A drawback of thermally-responsive record materials limiting utilization in certain environments and applications has been the undesirable tendency of thermally-responsive record materials upon forming an image to not retain that image in its original integrity over time when the thermally-responsive record material is exposed to environments of high heat. As a result, a high degree of care and control in handling or storing imaged thermally-responsive record materials is required. This loss of image density or fade can be a serious problem whenever the integrity of records is diminished through improper record storage.

To impart ability to a thermally-responsive record material to resist image fading in high heat environments would be an advance in the art and of commercial significance.

It is an object of the present invention to disclose a thermally-responsive record material having improved image retention and resistance to fade or erasure. The record material of the invention is remarkably resistant to fade or erasure from common external challenges particularly high heat such as in a 60° C. oven over a 24-hour time period.

SUMMARY OF THE INVENTION

Figure 1:
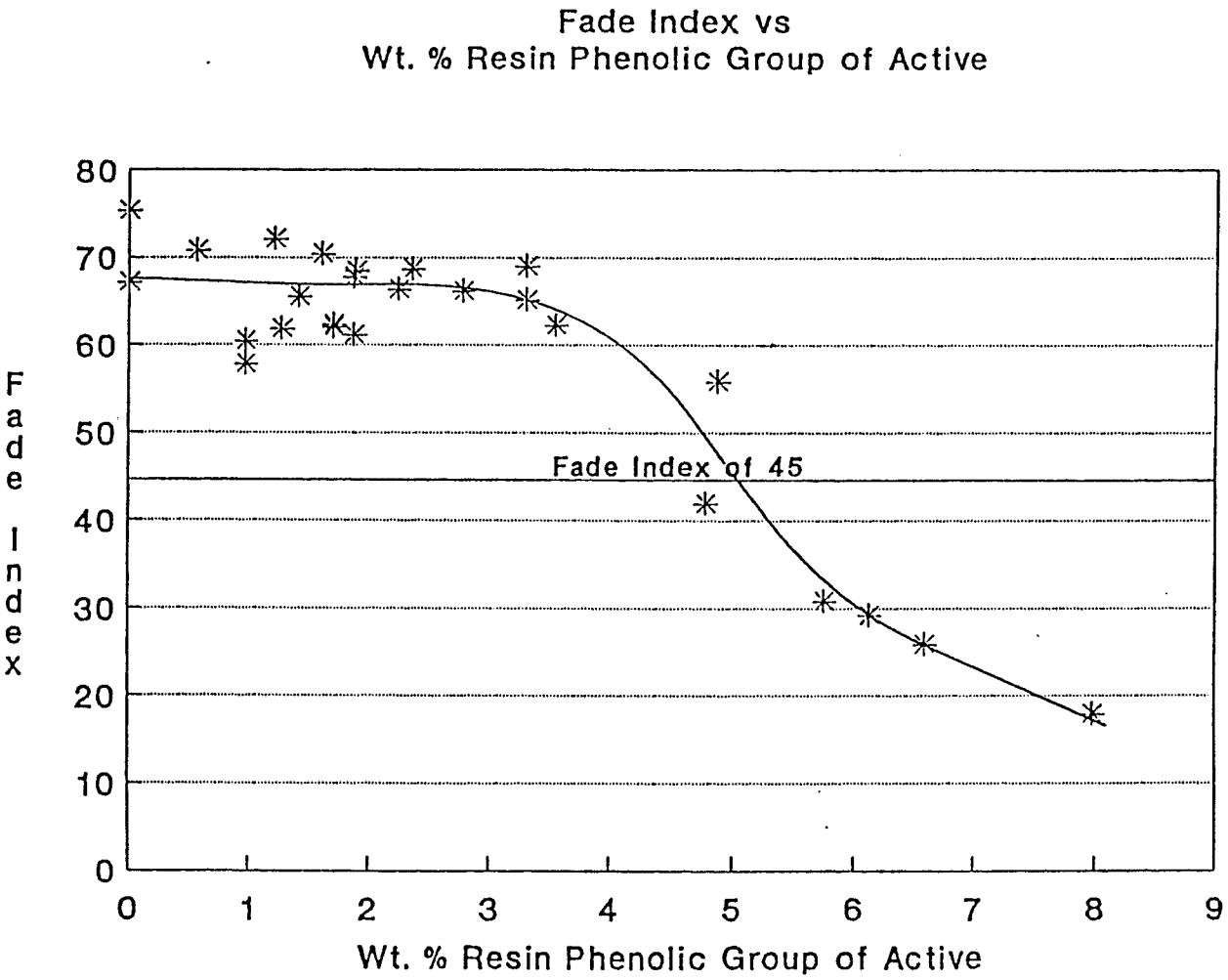
FIG. 1 is a graph of the dispersions of the weight percent resin phenolic group of the active components calculated as herein described and the fade index of the Examples.

The present invention is an improved thermally-responsive record material having improved image retention. The invention is an improved heat-sensitive record material, typically a sheet material, bearing a thermally-responsive color-forming composition comprising a chromogenic material, an acidic developer material and a color stabilizing resin that is an addition product of a diolefinic alkylated or alkenylated cyclic hydrocarbon, or, an addition product of a phenol and a diolefinic alkylated or alkenylated cyclic hydrocarbon with weight percent resin phenolic group of the active components being 5 or less.

The heat-sensitive recording material of the invention comprises a substrate bearing a thermally-sensitive color-forming composition comprising a chromogen, an electron-accepting color developer which reacts with said chromogenic material to form a color, and, a color stabilizing resin. The color stabilizing resin is selected from the group consisting of a) an addition product of a diolefinic alkylated or alkenylated cyclic hydrocarbon and b) an addition product of a phenol and a diolefinic alkylated or alkenylated cyclic hydrocarbon; the weight percent phenolic group of the chromogen, developer and stabilizing resin together being less than about 5. The weight percent phenolic group for the chromogen, developer and stabilizing resin is calculated by multiplying the weight percent phenolic group of the stabilizing resin by the weight of the stabilizing resin, then dividing by the sum of the weights of the chromogen, developer, and stabilizing resin, to yield a quotient, and multiplying the quotient by 100. The heat-sensitive recording material has a fade index greater than 45 when placed in a 60° C. oven for 24 hours.

The thermally-responsive record material of the invention has the unexpected and remarkable properties of being capable of forming a high density image upon selective thermal contact and of retaining that image over time when handled or exposed to high heat such as in a 60° C. oven for 24 hours. The remarkable ability of the composition of the heat-sensitive record material of the invention to impart fade and erasure resistance to thermally-responsive record materials is a significant advance in the art. The record materials of the invention were also found to resist fade from contact with other common external challenges such as oils, solvents, or plasticizers. However, these materials most consistently and unexpectedly stood out with reference to the herein-described high heat test.

Thermally-responsive or heat-sensitive recording materials bear a thermally-sensitive color-forming composition comprising a chromogenic material and an acidic developer material in substantially contiguous relationship, whereby the melting, softening or sublimation of either material produces a color, in other words a change-in-color reaction. The material of the invention in addition includes a color stabilizing material, namely a resin, comprising an addition product of a diolefinic alkylated or alkenylated cyclic hydrocarbon, or, an addition product of phenol and an alkylated or alkenylated cyclic hydrocarbon. The weight percent phenolic group of the active components is 5 or less. Active components for purposes of this invention is defined as the chromogen, the electron accepting color developer and the color stabilizing resin.

The color-stabilizing resin is an addition product of a diolefinic alkylated or alkenylated cyclic hydrocarbon, or, an addition product of phenol and a diolefinic alkylated or alkenylated cylic hydrocarbon. Methods of preparing terpene addition compounds or phenol terpene addition compounds are taught in U.S. Pat. No. 2,811,564 incorporated herein by reference. Preferred among the addition products of phenol and a diolefinic alkylated or alkenylated cyclic hydrocarbon are those in which the cyclic hydrocarbon is terpene. Terpenes include compounds such as limonene, α-terpinene, and the like.

The color-stabilizing resin by itself or in conjunction with other OH-bearing electron-donating materials must have weight percent phenolic group of 5 or less. The heat-sensitive recording material of the invention has a fade index of greater than 45.

The method of calculation of the weight percent phenolic group and the fade index are as described in detail herein.

Optionally, but preferably a modifier (also known as a sensitizer) such as a 1,32-diphenoxyethane is included. Such material typically does not impart any image on its own and is not considered active in the formation of color but as a relatively low melting solid acts as a solvent to facilitate reaction between the mark-forming components. Other such modifiers are described in U.S. Pat. No. 4,531,140. Other modifiers for example can include acetoacet-o-toluidine, phenyl-1-hydroxy-2-naphthoate, dibenzyloxalate, and para-benzylbiphenyl.

The color-forming composition (or system) of the record material of this invention comprises chromogenic material in its substantially colorless state and acidic developer material. The color-forming system typically relies upon melting, softening, or subliming one or more of the components to achieve reactive, color-producing contact.

The record material includes a substrate or support material which is generally in sheet form. For purposes of this invention, sheets can be referred to as substrates or support members and are understood to also mean webs, ribbons, tapes, belts, films, labels, cards and the like. Sheets denote articles having two large surface dimensions and a comparatively small thickness dimension. The substrate or support material can be opaque, transparent or translucent and could, itself, be colored or not. The material can be fibrous including, for example, paper and filamentous synthetic materials. It can be a film including, for example, cellophane and synthetic polymeric sheets cast, extruded, or otherwise formed. Invention resides in the color-forming composition coated on the substrate. The kind or type of substrate material is not critical.

The components of the color-forming system are in a proximate relationship meaning, a substantially contiguous or near contiguous relationship, substantially homogeneously distributed throughout the coated layer material deposited on the substrate in one or more layers. In manufacturing the record material, a coating composition is prepared which includes a fine dispersion of the components of the color-forming system, binder material typically a polymeric material, surface active agents and other additives in an aqueous coating medium. The composition can additionally contain inert pigments, such as clay, talc, aluminum hydroxide, calcined kaolin clay and calcium carbonate; synthetic pigments, such as urea-formaldehyde resin pigments; natural waxes such as Carnauba wax; synthetic waxes; lubricants such as zinc stearate; wetting agents; defoamers, and antioxidants.

The color-forming system components are substantially insoluble in the dispersing vehicle (preferably water) and are ground to an individual average particle size of between about 1 micron to about 10 microns, preferably less than 3 microns. A binder can be included. The binder can be a polymeric material and is substantially vehicle soluble although latexes are also eligible in some instances. Preferred water soluble binders include polyvinyl alcohol, hydroxy ethylcellulose, methylcellulose, methyl-hydroxypropylcellulose, starch, styrene maleic anhydride salts, modified starches, gelatin and the like. Eligible latex materials include polyacrylates, styrene-butadiene-rubber latexes, polyvinylacetates, polystyrene, and the like. The polymeric binder is used to protect the coated materials from brushing and handling forces occasioned by storage and use of thermal sheet. Binder should be present in an amount to afford such protection and in an amount less than will interfere with achieving reactive contact between color-forming reactive materials.

Coating weights can effectively be about 3 to about 9 grams per square meter (gsm) and preferably about 5 to about 6 gsm. The practical amount of color-forming materials is controlled by economic considerations, functional parameters and desired handling characteristics of the coated sheets.

Eligible chromogens, such as the phthalide, leucauramine and fluoran compounds, for use in the color-forming system are well known color-forming compounds. Examples of the compounds include Crystal Violet Lactone (3,3-bis(4-dimethylaminophenyl)-6-dimethylaminophthalide, U.S. Pat. No. Re. 23,024); phenyl-, indol-, pyrrol-, and carbazol-substituted phthalides (for example, in U.S. Pat. Nos. 3,491,111; 3,491,112; 3,491,116; 3,509,174); nitro-, amino-, amido-, sulfonamido-, aminobenzylidene-, halo-, anilino-substituted fluorans (for example, in U.S. Pat. Nos. 3,624,107; 3,627,787; 3,641,011; 3,642,828; 3,681,390); spirodipyrans (U.S. Pat. No. 3,971,808); and pyridine and pyrazine compounds (for example, in U.S. Pat. Nos. 3,775,424 and 3,853,869). Other specifically eligible chromogenic compounds, not limiting the invention in any way, are:

3-diethylamino-6-methyl-7-anilino-fluoran (U.S. Pat. No. 3,681,390); 2-anilino-3-methyl-6-dibutylamino-fluoran (U.S. Pat. No. 4,510,513) also known as 3-dibutylamino-6-methyl-7-anilino-fluoran; 3-dibutylamino-7-(2-chloroanilino)fluoran; 3-(N-ethyl-N-tetrahydrofurfurylamino)-6-methyl-7-3,5'6-tris(dimethylamino)spiro[9H-fluorene-9,1'(3'H)-isobenzofuran]3'-one; 7-(1-ethyl-2-methylindol-3-yl)-7-(4-diethyl-amino-2-ethoxyphenyl)-5,7-dihydrofuro[3,4-b]pyridin-5-one (U.S. Pat. No 4,246,318); 3-diethylamino-7-(2-chloroanilino)fluoran (U.S. Pat. No. 3,920,510); 3-(N-methylcyclohexylamino)-6-methyl-7-anilinofluoran (U.S. Pat. No. 3,959,571); 7-(1-octyl-2-methylindol-3-yl)-7-(4-diethyl-amino-2-ethoxyphenyl)-5,7-dihydrofuro[3,4-b]pyridin-5-one; 3-diethylamino-7,8-benzofluoran; 3,3-bis(1-ethyl-2-methylindol-3-yl)phthalide; 3-diethylamino-7-anilinofluoran; 3-diethylamino-7-benzylaminofluoran; 3'-phenyl-7-dibenzylamino-2,2'-spirodi-[2H-1-benzopyran] and mixtures of any of the above.

Examples of eligible acidic or electron-accepting color-developer material include the compounds listed in U.S. Pat. No. 3,539,375 as phenolic reactive material, particularly the monophenols and diphenols. Eligible acidic developer material also includes, without being considered as limiting, the following compounds which may be used individually or in mixtures: 4,4'-isopropylidine- diphenol (Bisphenol A); p-hydroxybenzaldehyde; p-hydroxybenzophenone; p-hydroxypropiophenone; 2,4-dihydroxybenzophenone; 1,1-bis(4-hydroxyphenyl)cyclohexane; salicyanilide; 4-hydroxy-2-methylacetophenone; 2-acetylbenzoic acid; m-hydroxyacetanilide; p-hydroxyacetanilide; 2,4-dihydroxyacetophenone; 4-hydroxy-4'-methylbenzophenone; 4,4'-dihydroxybenzophenone; bis(3-allyl-4-hydroxyphenyl) sulfone, 2,2-bis(4-hydroxy- phenyl)-4-methylpentane; benzyl-4-hydroxyphenyl ketone; 2,2-bis(4-hydroxyphenyl)-5-methylhexane; ethyl-4,4-bis(4-hydroxyphenyl)-pentanoate; isopropyl-4,4-bis(4-hydroxyphenyl)pentanoate; methyl-4,4-bis(4-hydroxyphenyl)pentanoate; allyl-4,4-bis(4-hydroxyphenyl)pentanoate; 3,3-bis(4-hydroxyphenyl)-pentane; 4,4-bis(4-hydroxyphenyl)heptane; 2,2-bis(4-hydroxyphenyl)-1-phenylpropane; 2,2-bis(4-hydroxyphenyl)butane; 2,2'-methylene-bis(4-ethyl-6-tertiarybutylphenol); 4-hydroxycoumarin; 7-hydroxy-4-methylcoumarin; 2,2'-methylene-bis(4-octylphenol); 4,4'-sulfonyldiphenol; 4,4'-thiobis(6-tertiarybutyl-m-cresol); methyl-p-hydroxybenzoate; n-propyl-p-hydroxybenzoate; benzyl-p-hydroxybenzoate; 4-(4-(1-methylethoxy)phenyl) sulphonyl phenol. Preferred among these are the phenolic developer compounds. More preferred among the phenol compounds are 4,4'-isopropylindinediphenol, ethyl-4,4-bis(4hydroxyphenyl)pentanoate, n-propyl-4,4-bis(4-hydroxyphenyl) pentanoate, isopropyl-4,4-bis(4-hydroxyphenyl)pentanoate, methyl-4,4-bis(4-hydroxyphenyl)pentanoate, 2,2-bis(4-hydroxyphenyl)-4-methylpentane, p-hydroxybenzophenone, 2,4-dihydroxybenzophenone, 1,1-bis(4-hydroxyphenyl)cyclohexane, and benzyl-p-hydroxybenzoate; 4-(4-(1-methylethoxy)-phenyl)sulphonyl phenol and 4,4'-[1,3-phenylenebis(1-methylethylene]bisphenol. Acid compounds of other kind and types are eligible. Examples of such other compounds are phenolic novolak resins which are the product of reaction between, for example, formaldehyde and a phenol such as an alkylphenol, e.g., p-octylphenol, or other phenols such as p-phenylphenol, and the like; and acid mineral materials including colloidal silica, kaolin, bentonite, attapulgite, hallosyte, and the like. Some of the polymers and minerals do not melt but undergo color reaction on fusion of the chromogen. Of the foregoing particularly the phenol type of compounds are more preferable acidic developer materials.

The following examples are given to illustrate some of the features of the present invention and should not be considered as limiting. In these examples all parts or proportions are by weight and all measurements are in the metric system, unless otherwise stated.

In all examples illustrating the present invention a dispersion of a particular system component was prepared by milling the component in an aqueous solution of the binder until a particle size of between about 1 micron and 10 microns was achieved. The desired average particle size was less than 3 microns in each dispersion.

The thermally-responsive sheets were made by making separate dispersions of chromogenic material and acidic material. The dispersions were mixed in the desired ratios and applied to a support with a wire wound rod and dried. Other non-active (as that term is understood in this application) materials such as modifiers, fillers, antioxidants, lubricants and waxes can be added if desired. The sheets may be calendered to improve smoothness.

In the examples the thermal response of the sheets was checked by imaging with a Group III facsimile machine. The facsimile machine used included SHARP 220. The color produced was measured with a Macbeth RD514 densitometer, #106 filter.

The dispersions were prepared in a quickie mill, attritor and small media mill. Nopco NDW is a sulfonated castor oil produced by Nopco Chemical Company. Surfynol 104 is a di-tertiary acetylene glycol surface active agent produced by Air Products and Chemicals, Inc. Zonerez is a trademark of Arizona Chemical Company. Zonerez 7125 is a polyterpene, more particularly an addition product of d-limonene. Piocofyn is a trademark of Hercules Inc. Piccofyn T-125 is an α-pinene and phenol addition product.

Dispersion A-1—Chromogenic Material is N-102

3-diethylamino-6-methyl-7-anilinofluoran.

| | Parts |
|---|---|
| N-102 | 94.95 |
| PVA, Vinol 205, 20% in Water | 81.00 |
| Nopco NDW | 0.23 |
| Surfynol 104 | 1.13 |
| Water | 122.69 |

Dispersion A-2—Chromogenic material is TECVIL, 3,3-bis(4-diethylaminophenyl)-6-dimethylaminophthalide Dispersion prepared the same as A-1 but using TECVIL.

Dispersion A-3—Chromogenic material is PB63, isomeric mixture of 7-(1-ethyl-2-methylindol-3-yl)-7-(4-diethylamine-2-ethoxyphenyl)-6,7-dihydrofuro[3,4-b]pyridin-5-one and 5-(1-ethyl2-methylindol-3-yl)-5-(4-diethylamine-2-ethoxyphenyl)-5,7-dihydrofuro[3,4-b]pyridin-7-one Dispersion prepared the same as A-1 but using PB63.

Dispersion B-1—Acidic Material is AP-5

2,2-bis(4-hydroxyphenyl)-4-methyl pentane.

| | Parts |
|---|---|
| AP-5 | 102.00 |
| PVA, Vinol 203, 28% in Water | 62.14 |
| Nopco NDW | 0.12 |
| Surfynol 104 | 0.48 |
| Water | 135.26 |

Dispersion B-2—Acidic material is TGSA

Bis(3-alkyl-4-hydroxyphenyl)sulfone.

Dispersion prepared the same as B-1 but using TGSA.

Dispersion B-3—Acidic material is Benzyl Paraben

Dispersion prepared the same as B-1 but using phenyl paraben.

Dispersion B-4—Acidic material is D8, 4(4-(1-methylethoxy)phenyl)sulphonylphenol Dispersion prepared the same as B-1 but using D8.

Dispersion C-1—Sensitizer is DPE

| | Parts |
|---|---|
| DPE | 102.00 |
| PVA, Vinol 203, 28% in Water | 62.14 |
| Nopco NDW | 0.12 |
| Surfynol 104 | 0.48 |
| Water | 135.26 |

Dispersion C-2—Sensitizer is DBO

| | |
|---|---|
| DBO | 82.29 |
| Vinol 203, 28% in Water | 70.18 |
| Nopco NDW | 0.10 |
| Surfynol 104 | 0.39 |
| Water | 123.64 |

Dispersion D-1—Resin has 0% weight percent phenolic group of resin

Zonarez 7125 . . . Polyterpene Resin.

| | |
|---|---|
| 0% Hydroxyl Resin | 17.00 |
| PVA, Vinol 203, 28% in Water | 10.36 |
| Nopco NDW | 0.02 |
| Surfynol 104 | 0.08 |
| Water | 72.54 |

Dispersion D-2—Resin melt has 3.2 weight percent phenolic group of resin

88:12 . . . Zonarez 7125:Piccofyn T-125.

Dispersion prepared the same as D-1 but using 3.2 weight percent phenolic group of resin resin.

Dispersion D-3—Resin melt has 6.75 weight percent phenolic group of resin

75:25 . . . Zonarez 7125:Piccofyn T-125.

Dispersion prepared the same as D-1 but using 6.75 weight percent phenolic group of resin resin.

Dispersion D-4—Resin melt has 8.1 weight percent phenolic group of resin

70:30 . . . Zonarez 7125:Piccofyn T-125.

Dispersion prepared the same as D-1 but using 8.1 weight percent phenolic group of resin resin.

Dispersion D-5—Resin melt has 9.2 weight percent phenolic group of resin

66:34 . . . Zonarez 7125:Piccofyn T-125.

Dispersion prepared the same as D-1 but using 9.2 weight percent phenolic group of resin resin.

Dispersion D-6—Resin melt has 10.8 weight percent phenolic group of resin

60:40 . . . Zonarez 7125:Piccofyn T-125.

Dispersion prepared the same as D-1 but using 10.8 weight percent phenolic group of resin.

Dispersion D-7—Resin melt has 13.5 weight percent phenolic group of resin

50:50 . . . Zonarez 7125:Piccofyn T-125.

Dispersion prepared the same as D-1 but using 13.5 weight percent phenolic group of resin.

Dispersion D-8—Resin melt has 20.2 weight percent phenolic group of resin

25:75 . . . Zonarez 7125:Piccofyn T-125.

Dispersion prepared the same as D-1 but using 20.2 weight percent phenolic group of resin.

Dispersion D-9—Resin melt has 27.0 weight percent phenolic group of resin

Piccofyn T-125 . . . Terpene-Phenol Addition Product.

Dispersion prepared the same as D-1 but using 27 weight percent phenolic group of resin.

Test Formulations

| | Materials | Parts |
|---|---|---|
| Control-1 | Dispersion A-1 (N-102) | 1.64 |
| | Dispersion B-1 (AP-5) | 4.03 |
| | Dispersion C-1 (DPE) | 4.03 |
| | Filler | 1.53 |
| | PVA, Vinol 325, 10% in Water | 7.03 |
| | Zinc stearate, 31.74% | 1.13 |
| | Water | 10.61 |
| Example-1 | Dispersion A-1 (N-102) | 1.64 |
| | Dispersion B-1 (AP-5) | 3.03 |
| | Dispersion C-1 (DPE) | 4.03 |
| | Dispersion D-1 (Resin) | 1.76 |
| | Filler | 1.53 |
| | PVA, Vinol 325, 10% in Water | 7.03 |
| | Zinc stearate, 31.74% | 1.13 |
| | Water | 9.85 |
| Example-2 | Dispersion A-1 (N-102) | 1.64 |
| | Dispersion B-1 (AP-5) | 3.03 |
| | Dispersion C-1 (DPE) | 4.03 |
| | Dispersion D-2 (Resin) | 1.76 |
| | Filler | 1.53 |
| | PVA, Vinol 325, 10% in Water | 7.03 |
| | Zinc stearate, 31.74% | 1.13 |
| | Water | 9.85 |
| Example-3 | Dispersion A-1 (N-102) | 1.64 |
| | Dispersion B-1 (AP-5) | 3.03 |
| | Dispersion C-1 (DPE) | 4.03 |
| | Dispersion D-3 (Resin) | 1.76 |
| | Filler | 1.53 |
| | PVA, Vinol 325, 10% in Water | 7.03 |
| | Zinc stearate, 31.74% | 1.13 |
| | Water | 9.85 |
| Example-4 | Dispersion A-1 (N-102) | 1.64 |
| | Dispersion B-1 (AP-5) | 3.03 |
| | Dispersion C-1 (DPE) | 4.03 |
| | Dispersion D-4 (Resin) | 1.76 |
| | Filler | 1.53 |
| | PVA, Vinol 325, 10% in Water | 7.03 |
| | Zinc stearate, 31.74% | 1.13 |
| | Water | 9.85 |
| Example-5 | Dispersion A-1 (N-102) | 1.64 |
| | Dispersion B-1 (AP-5) | 3.03 |
| | Dispersion C-1 (DPE) | 4.03 |
| | Dispersion D-5 (Resin) | 1.76 |
| | Filler | 1.53 |
| | PVA, Vinol 325, 10% in Water | 7.03 |
| | Zinc stearate, 31.74% | 1.13 |
| | Water | 9.85 |
| Example-6 | Dispersion A-1 (N-102) | 1.64 |
| | Dispersion B-1 (AP-5) | 3.03 |
| | Dispersion C-1 (DPE) | 4.03 |
| | Dispersion D-6 (Resin) | 1.76 |
| | Filler | 1.53 |
| | PVA, Vinol 325, 10% in Water | 7.03 |
| | Zinc stearate, 31.74% | 1.13 |
| | Water | 9.85 |
| Example-7 | Dispersion A-1 (N-102) | 1.64 |
| | Dispersion B-1 (AP-5) | 3.03 |
| | Dispersion C-1 (DPE) | 4.03 |
| | Dispersion D-7 (Resin) | 1.76 |
| | Filler | 1.53 |
| | PVA, Vinol 325, 10% in Water | 7.03 |
| | Zinc stearate, 31.74% | 1.13 |
| | Water | 9.85 |
| Example-8 | Dispersion A-1 (N-102) | 1.64 |
| | Dispersion B-1 (AP-5) | 3.03 |
| | Dispersion C-1 (DPE) | 4.03 |
| | Dispersion D-8 (Resin) | 1.76 |
| | Filler | 1.53 |
| | PVA, Vinol 325, 10% in Water | 7.03 |
| | Zinc stearate, 31.74% | 1.13 |
| | Water | 9.85 |
| Example-9 | Dispersion A-1 (N-102) | 1.64 |
| | Dispersion B-1 (AP-5) | 3.03 |
| | Dispersion C-1 (DPE) | 4.03 |
| | Dispersion D-9 (Resin) | 1.76 |
| | Filler | 1.53 |
| | PVA, Vinol 325, 10% in Water | 7.03 |

-continued

Test Formulations

| | Materials | Parts |
|---|---|---|
| | Zinc stearate, 31.74% | 1.13 |
| | Water | 9.85 |
| Control-2 | Dispersion A-1 (N-102) | 1.64 |
| | Dispersion B-1 (AP-5) | 4.03 |
| | Dispersion C-2 (DBO) | 4.03 |
| | Filler | 1.53 |
| | PVA, Vinol 325, 10% in Water | 7.03 |
| | Zinc stearate, 31.74% | 1.13 |
| | Water | 10.61 |
| Example-10 | Dispersion A-1 (N-102) | 1.64 |
| | Dispersion B-1 (AP-5) | 3.03 |
| | Dispersion C-2 (DBO) | 4.03 |
| | Dispersion D-3 (Resin) | 1.76 |
| | Filler | 1.53 |
| | PVA, Vinol 325, 10% in Water | 7.03 |
| | Zinc stearate, 31.74% | 1.13 |
| | Water | 9.85 |
| Control-3 | Dispersion A-1 (N-102) | 1.39 |
| | Dispersion B-1 (AP-5) | 2.35 |
| | Dispersion C-1 (DPE) | 2.35 |
| | Urea formaldehyde filler | 0.27 |
| | Silica filler | 0.45 |
| | Paraffin wax | 0.06 |
| | Methylol bis stearamide | 0.29 |
| | Zinc stearate, 32.3% | 0.79 |
| | Hydroxypropyl methylcellulose, 10% in water | 0.36 |
| | PVA, Vinol 325, 10% in water | 2.65 |
| | Water | 7.92 |
| Example 11 | Dispersion A-1 (N-102) | 1.39 |
| | Dispersion B-1 (AP-5) | 2.35 |
| | Dispersion C-1 (DPE) | 2.35 |
| | Dispersion D-3 (Resin) | 2.35 |
| | Urea formaldehyde filler | 0.12 |
| | Silica filler | 0.20 |
| | Paraffin wax | 0.06 |
| | Methylol bis stearamide | 0.29 |
| | Zinc stearate, 32.3% | 0.79 |
| | Hydroxypropyl methylcellulose, 10% in water | 0.36 |
| | PVA, Vinol 325, 10% in Water | 1.97 |
| | Water | 6.63 |
| Example-11a | Same as Example-11 except resin used is Dispersion D-1. | |
| Example-11b | Same as Example-11 except resin used is Dispersion D-5. | |
| Example-11c | Same as Example-11 except resin used is Dispersion D-7. | |
| Example-11d | Same as Example-11 except resin used is Dispersion D-8. | |
| Example-11e | Same as Example-11 except resin used is Dispersion D-9. | |
| Control-4 | Same as Control-3 except the chromogenic material used is Dispersion A-2 (TECVIL) | |
| Example 12 | Same as Example-11 except chromogenic material is Dispersion A-2 (TECVIL) | |
| Control-5 | Same as Control-3 except chromogenic material is Dispersion A-3 (PB63). | |
| Example 13 | Same as Example-11 except chromogenic material is Dispersion A-3 (PB63) | |
| Control-6 | Same as Control-3 except acidic material is Dispersion B-2 (TGSA). | |
| Example-14 | Same as Example-11 except acidic material is Dispersion B-2 (TGSA). | |
| Control-7 | Same as Control-3 except acidic material is Dispersion B-3 (benzyl paraben). | |
| Example-15 | Same as Example-11 except acidic material is Dispersion B-3 (benzylparaben). | |
| Control-8 | Same as Control-3 except acidic material is Dispersion B-4 (D8). | |
| Example-16 | Same as Example-11 except acidic material is Dispersion B-4 (D8). | |
| Control-9 | Same as Control-3 except acrawax emulsion replaces zinc stearate. | |
| Example-17 | Same as Example-11 except acrawax emulsion replaces zinc stearate. | |
| Control-10 | Same as Control-3 except calcium stearate emulsion replaces zinc stearate. | |
| Example 18 | Same as Example-11 except calcium stearate emulsion replaces zinc stearate. | |
| Example-19 | Dispersion A-1 (N-102) | 1.39 |
| | Dispersion B-1 (AP-5) | 2.35 |
| | Dispersion C-1 (DPE) | 2.35 |
| | Dispersion D-3 (Resin) | 1.18 |
| | Urea formaldehyde filler | 0.20 |
| | Silica filler | 0.32 |
| | Paraffin wax | 0.06 |
| | Methylol bis-stearamide | 0.29 |
| | Zinc stearate, 32.3% | 0.79 |
| | Hydroxypropyl methylcellulose, 10% in water. | 0.36 |
| | PVA, Vinol 325, 10% in water | 2.31 |
| | Water | 7.26 |
| Example-19a | Same as Example-19 except resin used is Dispersion D-5. | |
| Example-19b | Same as Example-19 except resin used is Dispersion D-7. | |
| Example-19c | Same as Example-19 except resin used is Dispersion D-8. | |
| Example-20 | Dispersion A-1 (N-102) | 1.39 |
| | Dispersion B-1 (AP-5) | 2.35 |
| | Dispersion C-1 (DPE) | 2.35 |
| | Dispersion D-9 (Resin) | 1.98 |
| | Urea formaldehyde filler | 0.15 |
| | Silica filler | 0.24 |
| | Paraffin wax | 0.06 |
| | Methylol bis-stearamide | 0.29 |
| | Zinc stearate, 32.3% | 0.79 |
| | Hydroxypropyl methylcellulose, 10% in water | 0.36 |
| | PVA, Vinol 325, 10% in water | 2.08 |
| | Water | 6.82 |
| Example-21 | Dispersion A-1 (N-102) | 1.39 |
| | Dispersion B-1 (AP-5) | 2.35 |
| | Dispersion C-1 (DPE) | 2.35 |
| | Dispersion D-9 (Resin) | 2.14 |
| | Urea formaldehyde filler | 0.13 |
| | Silica filler | 0.16 |
| | Paraffin wax | 0.06 |
| | Methylol bis-stearamide | 0.29 |
| | Zinc stearate, 32.3% | 0.79 |
| | Hydroxypropyl methylcellulose, 10% in water | 0.36 |
| | PVA, Vinol 325, 10% in water | 2.03 |
| | Water | 6.81 |
| Example-22 | Dispersion A-1 (N-102) | 1.39 |
| | Dispersion B-1 (AP-5) | 2.35 |
| | Dispersion C-1 (DPE) | 2.35 |
| | Dispersion D-9 (Resin) | 3.06 |
| | Urea formaldehyde filler | 0.08 |
| | Silica filler | 0.12 |
| | Paraffin wax | 0.06 |
| | Methylol bis-stearamide | 0.29 |
| | Zinc stearate, 32.3% | 0.79 |
| | Hydroxypropyl methylcellulose, 10% in water | 0.36 |
| | PVA, Vinol 325, 10% in water | 1.77 |
| | Water | 6.24 |

The image fade and fade index after 24 hours in a 60° C. oven are shown in Table 1.

60° C. Oven Fade Test and The Calculation of Fade Index

The 60° C. oven fade test is a routine test used to simulate long term aging of a thermal print.

In this test:

1. The sample may be imaged by a Dynamic tester, Fax machine (in this case a Sharp 220) or static tester. The sample must be imaged by sufficient energy to achieve an initial MacBeth reading of 1.1.
2. The image density is measured on a Macbeth densitometer and recorded. The unimaged sheet opacity (background) is measured by an opacimeter and recorded.

3. The imaged sample is then hung vertically in an oven at 60° C. for 24 hrs. Multiple samples are hung so that free air flow between the samples is allowed.
4. At the end of the 24 hr. test period the sample is removed from the oven and the image density and background opacity are remeasured and recorded by the Macbeth densitometer and opacimeter, respectively.
5. Loss in image density (intensity) is calculated by subtracting the final image density from the initial density and dividing by initial density. This can be referred to as percent fade.
6. Any darkening of the background (unimaged area) can be determined from the difference in the final opacity from the initial opacity.

Calculation of Fade Index

The % fade as determined by step 5 above is a good indication of print stability as long as the background does not change. With thermal systems, exposure to low heat levels over long periods of time can gradually darken the background due to premature color formation. The question becomes one of determining what part of image stability is due to fade of the image versus premature background coloration.

It is preferable to view the stability of a thermal image not in % fade but rather in % print remaining. The first portion of the fade index calculation does this conversion.

$$M = \%\ \text{Image remaining} = 100 - \%\ \text{Fade} = 1 - \frac{\text{Macbeth Initial-Macbeth Final}}{\text{Macbeth initial}} \times 100$$

or $$M = \frac{\text{Macbeth final}}{\text{Macbeth initial}} \times 100$$

The next step is to determine a factor to correct for background change after exposure. Background readings on the opacimeter are expressed as the actual opacimeter reading times 100 (ie. $0.845 \times 100 = 84.5$ reported). Additionally, the opacimeter scale is reversed. A value of 1 (100) represents the standard reference for a white surface. A 0 (zero) value is used as the standard reference for a black surface. The opacimeter measures the ability to hide the surface. Infinite thickness of the colored layer or image is assumed. Since our image color is black we can assume our scale goes from 1 to 0.

In order to reverse the measured number, to get it on a "larger is better" or background whiteness remaining scale, the first step of this calculation is to subtract the actual opacimeter reading from one.

$W = 1 - I/I_0$ (where $I/I_0$ is the actual opacimeter reading)

A correction is done for the fact that we are not dealing with a surface of infinite thickness. The negative log of the opacimeter reading (in this case W) gives a good linear relationship between dye reacted and image intensity.

$$B32 - \log W$$

Now we can calculate a conversion factor. If $B_I$ represent the initial background and BF the final background, the increase in background or % of image stability due to background increase is:

$$D = \frac{B_I - B_F}{B_I}$$

We now know the Image retained (M) and the image due to background increase (D). The question becomes, what part of the image stability is due to the fade of the image v. premature background coloration? We can calculate the image retention due to fade of the image v. premature background coloration as $$\text{Fade Index} = \text{FI} = M(1 - D)$$

Calculation of Weight Percent Resin Phenolic Group of Active Components

The Weight % Resin Phenolic component of the active components (chromogen, developer and color stabilizing resin together) and thus contributed to by the addition product of a phenol and a diolefinic alkylated or alkenylated cyclic hydrocarbon, (conventionally referred to as polyterpene resin, polyterpene/terpene-phenol resin blend or terpene-phenol resin) is calculated as follows:

| | |
|---|---|
| Active components | chromogen (dye)<br>electron-accepting color developer (developer)<br>color stabilizing resin (resin) |

$$(100 \times) \frac{\text{Wt \% phenolic group of color stabilizing resin} \times \text{Wt color stabilizing resin}}{(\text{Wt chromogen} + \text{Wt color developer} + \text{Wt color stabilizing resin})} = \text{Wt \% Resin Phenolic Group of Acitve}$$

Wt % phenolic group of the resin is determined as follows

The procedures used to measure weight percent phenolic group are very similar to those used to measure hydroxyl unit; however, the data are treated somewhat differently. In this procedure, hydroxyl content is expressed as the weight of hypothetical phenolic group ($-C_6H_4OH$, molecular weight 93.11) which would possess the same number of phenolic hydroxyls as 1 gram of unknown sample, expressed as a percentage.

Example—high purity phenolic material of definite chemical structure: 4-cumylphenol, molecular weight 212.3

Weight Percent Phenolic Group $= (93.11/212.3) \times 100 = 43.9\%$

This method of defining hydroxyl content is slightly (about 1%) different than defining hydroxyl content as weight percent phenol. Phenol is, of course, a real material having a molecular weight of 94.1. Weight percent phenolic group is used in order to avoid possible misunderstanding that the phenol/terpene condensation products contain appreciable amounts of unbound phenol.

In our procedure, solutions of high-purity paraalkyl-substituted phenols are prepared in tetrachloroethylene. The FTIR spectra are recorded and the integrated peak area (IPA) of the free phenolic hydroxyl absorption peak is recorded in absorbance units, which are proportional to concentration. A calibration plot is prepared by plotting IPA versus the product of weight percent phenolic group and solution concentration (in grams per milliliter). Solutions of unknown condensation products, having concentrations of about 1 to 10 milligrams per milliliter, are prepared in tetrachloroethylene. The IPA for these solutions is measured in the same way as for the standard solutions. Weight percent phenolic group is calculated by reading the result from the calibration curve and dividing by the solution concentration (g/mL).

This method is based upon the two assumptions:

1) the only hydroxyls in the unknown condensation products are phenolic hydroxyls;

2) quantitation of phenolic compounds is accomplished by infrared spectroscopy. See Goddu, R. F., *Analytical Chemistry,* vol. 30, no. 12, December 1958, pp. 2009–2013.

Table 1 is a test of the stability of image intensity in a test chamber at 60° C. The test chamber used was a constant temperature oven. As shown by Table the record material according to the invention when imaged is considerably more resistant to fade or erasure as compared to record materials not having the combination of the invention.

Table 2 lists the weight % resin phenolic group of active, meaning the % resin phenolic group of the active components calculated as described herein particularly under "Calculation of the Weight Percent Phenolic Group". The Fade Index is also calculated as herein described.

TABLE 2

| | Weight % Resin Phenolic Group of Active | Fade Index |
|---|---|---|
| Control 1 | No resin | 35.9 |
| Example 1 | 0 | 67.1 |
| Example 2 | 0.56 | 70.8 |
| Example 3 | 1.22 | 72.1 |
| Example 4 | 1.42 | 65.5 |
| Example 5 | 1.61 | 70.4 |
| Example 6 | 1.89 | 68.4 |
| Example 7 | 2.36 | 68.6 |
| Example 8 | 3.54 | 62.2 |
| Example 9 | 4.78 | 42 |
| Control 3 | No resin | 46.2 |
| Control 3 | No resin | 45.5 |
| Example 19 | 0.97 | 57.8 |
| Example 19 | 0.97 | 60.4 |
| Example 19a | 1.28 | 61.8 |
| Example 11 | 1.71 | 62.3 |
| Example 11 | 1.71 | 62 |
| Example 19b | 1.88 | 61.1 |
| Example 19b | 1.88 | 67.7 |
| Example 11b | 2.24 | 66.3 |
| Example 19c | 2.78 | 66.1 |
| Example 11c | 3.3 | 68.9 |
| Example 11c | 3.3 | 65.1 |
| Example 11d | 4.88 | 55.8 |
| Example 11e | 6.59 | 25.8 |
| Example 22 | 7.98 | 17.9 |
| Control 3 | No resin | 51.7 |
| Example 20 | 5.76 | 30.8 |
| Example 21 | 6.13 | 29.2 |
| Example 11a | 0 | 75.3 |

The principles, preferred embodiments, and modes of operation of the present invention have been described

TABLE 1

| | Average Initial Image Intensity MacBeth Reading | Average 24 Hr. 60° C. Image Intensity MacBeth Reading | Background Initial | Background 24 Hr. 60° C. Final | Fade Index |
|---|---|---|---|---|---|
| Control-1 | 1.19 | 0.47 | 83.5 | 80.2 | 35.9 |
| Example-1 | 1.15 | 0.82 | 85.0 | 83.0 | 67.1 |
| Example-2 | 1.19 | 0.91 | 84.6 | 82.3 | 70.8 |
| Example-3 | 1.22 | 0.97 | 83.9 | 80.9 | 72.1 |
| Example-4 | 1.12 | 0.81 | 84.6 | 81.6 | 65.5 |
| Example-5 | 1.20 | 0.97 | 83.9 | 79.6 | 70.4 |
| Example-6 | 1.20 | 0.92 | 83.2 | 79.4 | 68.4 |
| Example-7 | 1.17 | 0.93 | 81.1 | 76.9 | 68.6 |
| Example-8 | 1.22 | 1.06 | 81.5 | 68.9 | 62.2 |
| Example-9 | 1.23 | 1.14 | 76.0 | 50.3 | 42.0 |
| Control-2 | 1.23 | 0.39 | 86.1 | 79.7 | 25.6 |
| Example-10 | 1.32 | 0.65 | 86.5 | 73.8 | 32.9 |
| | Average Initial Image Intensity | Average 24 Hr. 60° C. Image Intensity | Background Initial | Background Final | Fade Index |
| Control 3 | 1.35 | 0.76 | 85.3 | 79.3 | 46.2 |
| | 1.37 | 0.78 | 85.4 | 78.3 | 45.5 |
| Example 19 | 1.32 | 0.88 | 85.6 | 82.3 | 57.8 |
| | 1.41 | 0.94 | 85.9 | 81.7 | 60.4 |
| Example 19a | 1.33 | 0.92 | 85.4 | 81.7 | 61.8 |
| Example 11 | 1.37 | 1.10 | 86.0 | 81.6 | 62.3 |
| | 1.33 | 0.95 | 86.2 | 82.1 | 62 |
| Example 19b | 1.33 | 0.92 | 84.2 | 80.4 | 61.1 |
| | 1.40 | 1.10 | 83.9 | 79.8 | 67.7 |
| Example 11b | 1.33 | 1.06 | 85.4 | 79.8 | 66.3 |
| Example 19c | 1.42 | 1.07 | 82.8 | 75.8 | 66.1 |
| Ecample 11c | 1.38 | 1.18 | 83.1 | 74.8 | 68.9 |
| | 1.30 | 1.06 | 83.6 | 76.4 | 65.1 |
| Example 11d | 1.35 | 1.20 | 80.9 | 64.7 | 55.8 |
| Example 11e | 1.35 | 1.31 | 82.8 | 37.3 | 25.8 |
| Example 22 | 1.36 | 1.32 | 82.3 | 27.2 | 17.9 |
| Control 3 | 1.42 | 1.00 | 85.7 | 76.0 | 51.7 |
| Example 20 | 1.37 | 1.31 | 81.3 | 41.7 | 30.8 |
| Example 21 | 1.37 | 1.31 | 79.9 | 38.8 | 29.2 |
| Example 11a | 1.37 | 1.19 | 86.8 | 82.7 | 75.3 |

in the foregoing specification. The invention which is intended to be protected herein, however, is not to be construed as limited to the particular forms disclosed, since these are to be regarded as illustrative rather than restrictive. Variations and changes can be made by those skilled in the art without departing from the spirit and scope of the invention.

Obvious and included variations would clearly include for example, rather than applying the components of the color forming system in one coating, multiple layers of the individual components can be applied. For example, a layer with modifier and developer and resin can be top coated with a layer containing chromogen and modifier. Another workable variation, equally within the scope of the invention would be to apply to a substrate a coating of developer, resin, and modifier over which is top coated a dispersion of chromogen, resin, developer and modifier. Other such structural variations would be clearly evident to the skilled worker in the art all without departing from the spirit and scope of the invention.

What is claimed is:

1. A heat-sensitive recording material comprising a substrate bearing a thermally-sensitive color-forming composition comprising a chromogen, an electron-accepting color developer which reacts with said chromogen to form a color, and, a color stabilizing resin selected from the group consisting of a) an addition product of a diolefinic alkylated or alkenylated cyclic hydrocarbon and b) an addition product of a phenol and a diolefinic alkylated or alkenylated cyclic hydrocarbon, the weight percent resin phenolic group of the chromogen, developer, and stabilizing resin together being less than about 5, the heat-sensitive recording material having a fade index greater than 45 when placed in a 60° C. oven for 24 hours.

2. The heat-sensitive recording material according to claim 1 wherein the color stabilizing resin is a polyterpene resin.

3. The heat-sensitive recording material according to claim 1 wherein the color stabilizing resin is an addition product of d-limonene.

4. The heat-sensitive recording material according to claim 1 wherein the color stabilizing resin is an addition product of phenol and α-pinene.

5. A heat-sensitive recording material comprising a substrate bearing a thermally-sensitive color-forming composition comprising a chromogen comprising a 3-dialkylamino-6-methyl-7-anilinofluoran, an electron-accepting color developer comprising 2,2-bis(4-hydroxyphenyl)-4-methylpentane which reacts with said chromogenic material to form a color, and, a color stabilizing resin selected from the group consisting of an addition product of a diolefinic alkylated or alkenylated cyclic hydrocarbon, and, an addition product of a phenol and a diolefinic alkylated or alkenylated cyclic hydrocarbon, the weight percent resin phenolic group of the chromogen, developer and stabilizing resin being less than about 5, the heat-sensitive recording material having a fade index greater than 45 when placed in a 60° C. oven for 24 hours.

6. The heat-sensitive recording material according to claim 5 wherein the color stabilizing material is a polyterpene.

7. The heat-sensitive recording material according to claim 5 wherein the color stabilizing material is an addition product of d-limonene.

8. The heat-sensitive recording material according to claim 5 wherein the color stabilizing resin is an addition product of phenol and α-pinene.

9. The heat-sensitive recording material according to claim 5 wherein the color stabilizing resin is a combination of d-limonene and an addition product of phenol and α-pinene.

10. The heat-sensitive recording material according to claim 9 including in addition a sensitizer comprising 1,2-diphenoxyethane.

11. The heat-sensitive recording material according to claim 10 including in addition a binder selected from polyvinylalcohol or hydroxypropyl methylcellulose.

* * * * *